US011282429B2

(12) United States Patent
Choi et al.

(10) Patent No.: US 11,282,429 B2
(45) Date of Patent: Mar. 22, 2022

(54) DISPLAY DEVICE AND POWER MANAGEMENT INTEGRATED CIRCUIT

(71) Applicant: SILICON WORKS CO., LTD., Daejeon (KR)

(72) Inventors: Jung Min Choi, Daejeon (KR); Seong Sik Yoon, Daejeon (KR); Sang Woo Kim, Daejeon (KR); Jung Hyun Tark, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/065,967

(22) Filed: Oct. 8, 2020

(65) Prior Publication Data

US 2021/0110751 A1 Apr. 15, 2021

(30) Foreign Application Priority Data

Oct. 14, 2019 (KR) ..... 10-2019-0126924

(51) Int. Cl.
*G09G 3/20* (2006.01)

(52) U.S. Cl.
CPC ..... *G09G 3/20* (2013.01); *G09G 3/2011* (2013.01); *G09G 2310/0275* (2013.01); *G09G 2330/021* (2013.01); *G09G 2330/025* (2013.01); *G09G 2330/028* (2013.01)

(58) Field of Classification Search
None
See application file for complete search history.

(56) References Cited

U.S. PATENT DOCUMENTS 5,731,797 A * 3/1998 Akiyama ..... G09G 3/02 345/96
6,188,395 B1 * 2/2001 Yatabe ..... G09G 3/3696 345/211
2018/0068627 A1 * 3/2018 Ota ..... G06F 3/0412

FOREIGN PATENT DOCUMENTS

JP 4803629 B2 10/2011
JP 2016061848 A 4/2016
JP 6462207 B2 1/2019

* cited by examiner

*Primary Examiner* — Dorothy Harris
(74) *Attorney, Agent, or Firm* — Fenwick & West LLP

(57) ABSTRACT

The present disclosure, which relates to a power management integrated circuit to dynamically control ripples of driving voltages, allows reducing power consumption of the power management integrated circuit in a section where there is no operation for a display.

13 Claims, 8 Drawing Sheets

DISPLAY DEVICE AND POWER MANAGEMENT INTEGRATED CIRCUIT

CROSS REFERENCE TO RELATED APPLICATION

This application claims priority from Republic of Korea Patent Application No. 10-2019-0126924, filed on Oct. 14, 2019, which is hereby incorporated by reference in its entirety.

BACKGROUND

1. Field of Technology

The present disclosure relates to a technology for dynamically controlling ripples of a driving voltage of a power management integrated circuit.

2. Description of the Prior Art

The most important issue regarding electronic devices, including mobile devices, is how to reduce power consumption. As electronic devices become downsized, the power consumption needs to be reduced. For this reason, research into the reduction of power consumption is being done. A display device used in almost all electronic devices may be a component where a considerable reduction of power consumption can be made. For a typical example, static currents of a source driver may be reduced.

There are various ideas for the reduction of current consumption of a display device. Most research focuses on reducing static currents present in integrated circuits to drive or control a display device. For a typical example, static currents of a source driver may be reduced by lowering the frame rate of a display so as to maximize the length of a blank section.

However, there is little research into the reduction of power consumption of a power management integrated circuit itself. Power consumption of a power management integrated circuit as well may be reduced in a blank section where no operation for a display is necessary. As with other driving circuits, a power management integrated circuit may be improved in terms of its power consumption.

In this regard, the present disclosure is to provide a technology for reducing power consumption of a power management integrated circuit by improving the management of ripples of power supplied by the power management integrated circuit.

SUMMARY

An aspect of the present disclosure is to provide a technology of roughly managing ripples of driving signals, supplied by a power management integrated circuit, in a section where there is no operation for a display.

Another aspect of the present disclosure is to provide a technology of controlling a ripple period of a driving voltage to be longer in a section where there is no operation for a display.

Still another aspect of the present disclosure is to provide a technology of reducing the number of times of driving voltage outputs in a section where there is no operation for a display.

To this end, in an aspect, there is provided a display device comprising: a panel comprising pixels to which image data is outputted; a data driving circuit to apply a data voltage corresponding to the image data to a pixel in a first time section, but not to apply a data voltage to a pixel in a second time section; and a power management integrated circuit to convert power supplied from outside to generate a driving voltage and to output the driving voltage to the data driving circuit, wherein the power management integrated circuit controls a fluctuation range of the driving voltage in the second time section to be wider than a fluctuation range of the driving voltage in the first time section.

In the display device, the power management integrated circuit may receive a timing control signal including timings for the first time section and the second time section and output the driving voltage in the first time section or in the second time section according to the timings.

In the display device, the timing control signal may be generated in the data driving circuit or a data processing circuit to control the data driving circuit and transmitted to the power management integrated circuit.

In the display device, the fluctuation range comprises a peak value which is a maximum level value of the driving voltage and a threshold value which is a minimum level value of the driving voltage, and the level of the driving voltage may ascend or descend between the threshold value and the peak value while it is being outputted.

In the display device, the power management integrated circuit may control the threshold value in the second time section to be lower than the threshold value in the first time section.

In the display device, the power management integrated circuit may stop generating the driving voltage during a skip period where the level of the driving voltage descends from the peak value to the threshold value and generate the driving voltage during a driving period where the level of the driving voltage ascends from the threshold value to the peak value.

In the display device, when the level of the driving voltage reaches the threshold value, the power management integrated circuit may start converting the power.

In the display device, the power management integrated circuit may stop converting the power when the level of the driving voltage reaches the peak value.

In the display device, the skip period may be longer than the driving period.

In the display device, the power management integrated circuit may control the skip period of the second time section to be longer as the threshold value of the second time section becomes lower.

In the display device, the power management integrated circuit may control the numbers of alternations of the driving period and the skip period in the second time section to be lesser as the threshold value of the second time section becomes lower.

In the display device, the driving voltage may form ripples by its level's ascending or descending between the threshold value and the peak value, a ripple may have a ripple amplitude which is a distance between the threshold value and the peak value, and the ripple amplitude of the second time section may be greater than the ripple amplitude of the first time section.

In another aspect, there is provided a power management integrated circuit comprising: a power stage to convert power supplied from outside to generate a driving voltage and to output the driving voltage; and a power control circuit to receive a timing control signal including timings for a first time section where a data voltage corresponding to image data is applied to a pixel and for a second time section where the data voltage is not applied to the pixel and to control the output of the driving voltage, wherein the power control circuit determines the first time section and the second time section according to the timings and controls the driving voltage such that a fluctuation range of the driving voltage in the second time section to be greater than a fluctuation range of the driving voltage in the first time section.

In the power management integrated circuit, the fluctuation range comprises a peak value which is a maximum level value of the driving voltage and a threshold value which is a minimum level value of the driving voltage, and the power control circuit may control the threshold value in the second time section to be lower than the threshold value in the first time section.

In the power management integrated circuit, when the level of the driving voltage reaches the threshold value, the power stage may convert the power.

In the display device, when the level of the driving voltage reaches the peak value, the power management integrated circuit may stop converting the power.

As described above, the present disclosure allows reducing power consumption in a power management integrated circuit in a section where there is no operation for a display. In addition, the present disclosure allows reducing power consumption as much as the numbers of outputs of driving voltages supplied by a power management integrated circuit in a section where there is no operation for a display.

DETAILED DESCRIPTION

Figure 1:
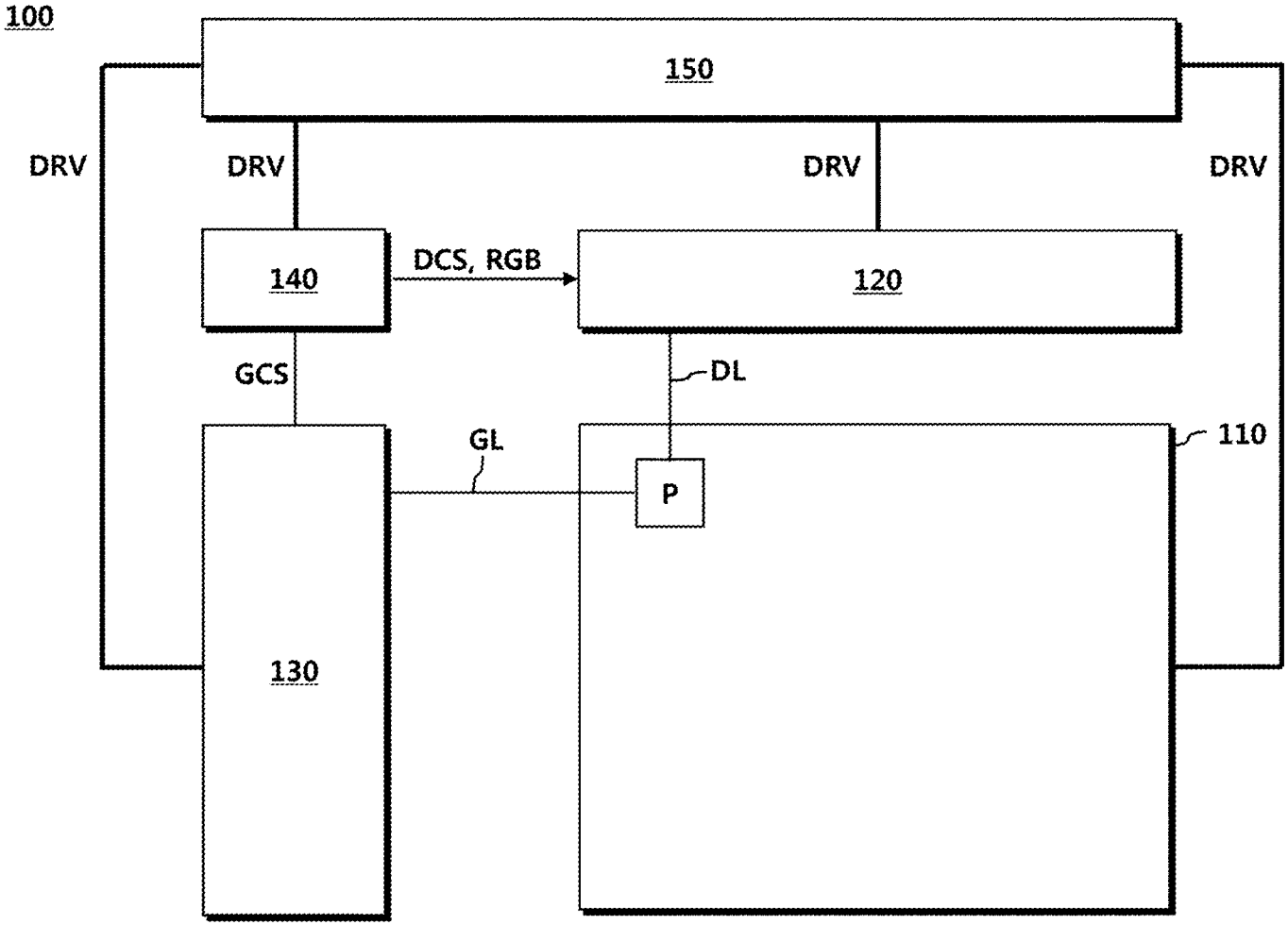
FIG. 1 is a configuration diagram of a display device according to an embodiment.

FIG. 1 is a configuration diagram of a display device according to an embodiment.

Referring to FIG. 1, a display device 100 may comprise a panel 110, a data driving circuit 120, a gate driving circuit 130, a data processing circuit 140, and a power management integrated circuit (PMIC) 150.

On the panel 110, a plurality of data lines DL and a plurality of gate lines GL may be disposed and a plurality of pixels P may also be disposed.

The gate driving circuit 130 may supply scan signals of turn-on voltages or turn-off voltages through the gate lines GL. When a scan signal of a turn-on voltage is supplied to a pixel P, the pixel P is connected with a data line DL and when a scan signal of a turn-off voltage is supplied to the pixel P, the pixel P is disconnected from the data line DL.

The data driving circuit 120 supplies data voltages through the data lines DL. A data voltage supplied through a data line DL is transferred to a pixel P connected with the data line DL according to a scan signal.

The data processing circuit 140 may supply various control signals to the gate driving circuit 130 and the data driving circuit 120. The data processing circuit 140 may generate a gate control signal GCS to initiate a scan according to a timing for each frame and transmit the gate control signal GCS to the gate driving circuit 130. The data processing circuit 140 may convert image data RGB inputted from outside into image data RGB in a data format used in the data driving circuit 120 and output the converted image data RGB to the data driving circuit 120. In addition, the data processing circuit 140 may transmit a data control signal DCS to control the data driving circuit 120 to supply a data voltage to each pixel P at an appropriate timing.

Meanwhile, a data driving circuit 120 may be referred to as a source driver, a gate driving circuit 130 may be referred to as a gate driver, and a data processing circuit 140 may be referred to as a timing controller. A data driving circuit 120 may be comprised in one integrated circuit together with a pixel sensing circuit and referred to as a source driver integrated circuit (IC). Otherwise, a data driving circuit 120, a pixel sensing circuit, and a data processing circuit may be comprised in one integrated circuit and referred to as a combined IC. Although the present disclosure is not limited to this, descriptions about some generally known components of a source driver, a gate driver, or a timing controller will be omitted in the descriptions of embodiments below. Accordingly, the descriptions of embodiments should be understood considering the fact that the descriptions about such some components are omitted.

The power management integrated circuit 150 may supply power to the panel 110, the data driving circuit 120, the gate driving circuit 130, and the data processing circuit 140. The power management integrated circuit 150 may supply power to them by transmitting driving voltages DRV to the panel 110, the data driving circuit 120, the gate driving circuit 130, and the data processing circuit 140 through power lines. Driving voltages DRV having different voltage values may respectively be supplied to the respective circuits. The power management integrated circuit 150 may act as a power source of the panel 110, the data driving circuit 120, the gate driving circuit 130, and the data processing circuit 140.

The panel 110 may be an organic light emitting display panel. In this case, each pixel P disposed on the panel 110 may comprise an organic light emitting diode (OLED) and at least one transistor. Characteristics of an organic light emitting diode OLED and at least one transistor comprised in each pixel P may vary depending on time or surrounding environments.

Figure 2:
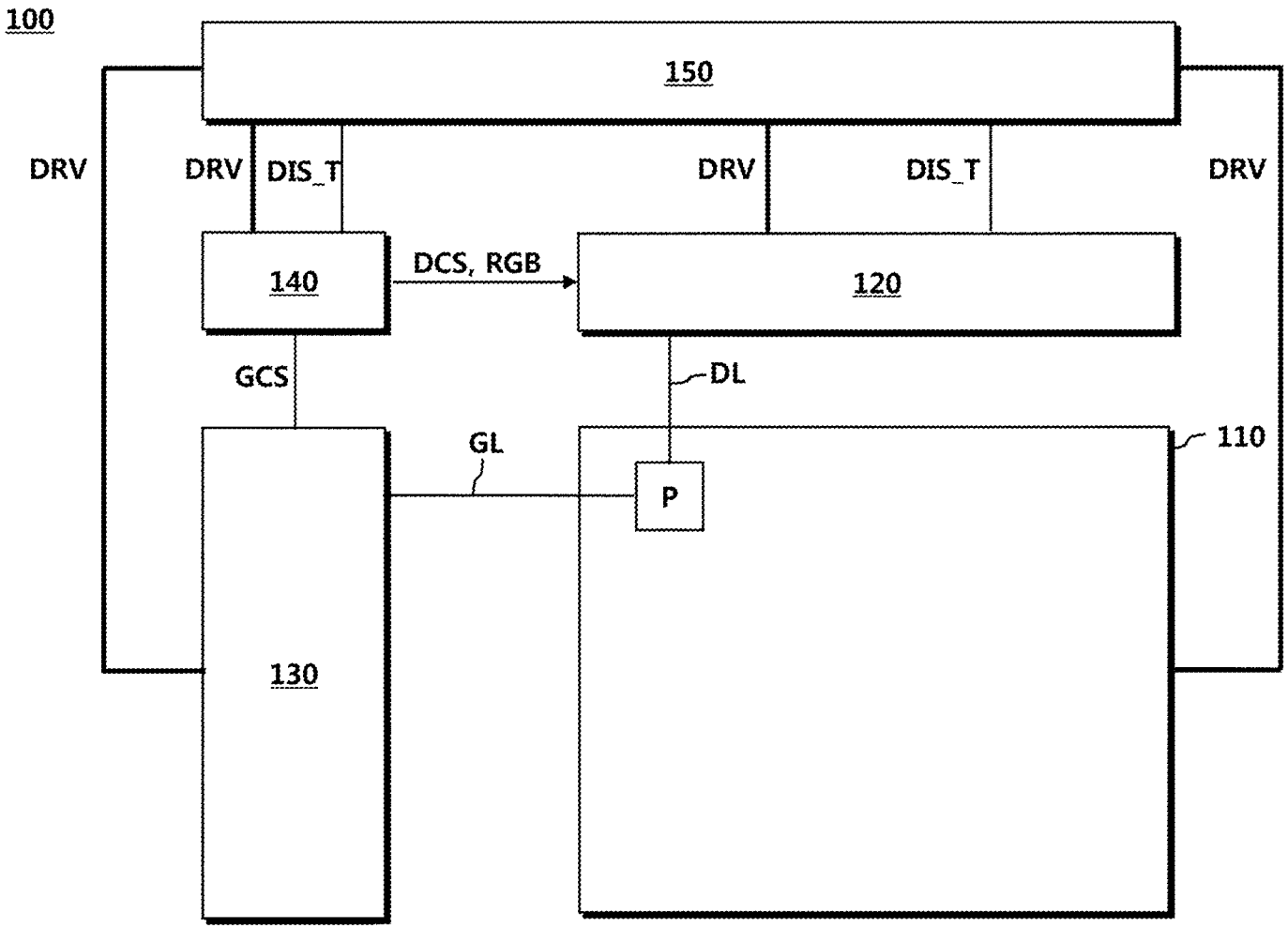
FIG. 2 is a configuration diagram of a display device including timing control signals according to an embodiment.

FIG. 2 is a configuration diagram of a display device including timing control signals according to an embodiment.

Referring to FIG. 2, a timing control signal DIS_T may be inputted from the data driving circuit 120 or the data processing circuit 140 to the power management integrated circuit 150.

The timing control signal DIS_T may be generated in the data driving circuit 120 or the data processing circuit 140 and transmitted to the power management integrated circuit 150.

The timing control signal DIS_T may comprise information regarding an operation status of the panel 110. The timing control signal DIS_T will be described in detail below.

The power management integrated circuit 150 may receive a timing control signal DIS_T and control a driving voltage DRV according to an operation status of the panel 110. In one embodiment, the power management integrated circuit 150 may differently adjust the fluctuation range of a driving voltage DRV according to an operation status of the panel 110.

Figure 3:
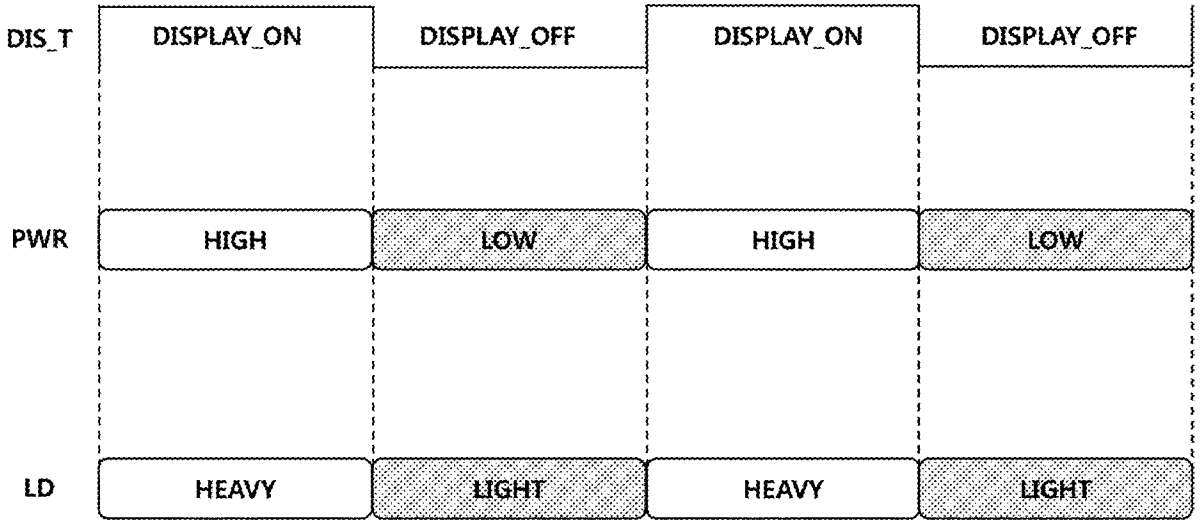
FIG. 3 is a diagram showing a timing control signal and corresponding changes of consumed power and a load according to an embodiment.

FIG. 3 is a diagram showing a timing control signal and corresponding changes of consumed power and a load according to an embodiment.

FIG. 3 shows the relation among a timing control signal DIS_T, power PWR supplied by the power management integrated circuit or power PWR consumed in the display device, and a load LD on the power management integrated circuit.

A timing control signal DIS_T may indicate an operation status of the panel (110 in FIG. 1). For example, a timing control signal DIS_T may indicate a display driving section DISPLAY_ON and a non-driving section DISPLAY_OFF. The display driving section DISPLAY-ON may be a section where the data driving circuit (120 in FIG. 1) drives the panel (110 in FIG. 1), for example, the data driving circuit supplies a data voltage corresponding to image data to a pixel. The display non-driving section DISPLAY_OFF may be a section where the data driving circuit (120 in FIG. 1) neither drives the panel (110 in FIG. 1) nor supplies a data voltage to a pixel. In the display non-driving section DISPLAY_OFF, operations other than the panel driving may be performed. For example, pixels or touches may be sensed in the display non-driving section DISPLAY_OFF.

A timing control signal DIS_T may be a horizontal synchronization signal HSYNC or a vertical synchronization signal VSYNC. The display driving section DISPLAY_ON and the display non-driving section DISPLAY_OFF may correspond respectively to a section, where a data voltage is applied, and a section, where a data voltage is not applied, indicated by a horizontal synchronization signal HSYNC or a vertical synchronization signal VSYNC.

Power consumed by the display device in the display driving section DISPLAY_ON may be different from power consumed thereby in the display non-driving section DISPLAY_OFF. In the display driving section DISPLAY_ON, a relatively large amount of power may be consumed compared with in the display non-driving section DISPLAY_OFF. The reason is that various circuits operate for driving the panel in the display driving section DISPLAY_ON, whereas relatively few circuits operate in the display non-driving section DISPLAY_OFF. In this figure, power PWR consumed in the display device corresponding to the display driving section DISPLAY_ON is indicated by HIGH and power PWR corresponding to the display non-driving section DISPLAY_OFF is indicated by LOW (sections in shade).

In each section, consumed power PWR may correspond to power supplied by the power management integrated circuit (150 in FIG. 1). Power PWR consumed by circuits in the display driving section DISPLAY_ON may be identical to power PWR supplied to the circuits in the display driving section DISPLAY_ON.

For example, in the display driving section DISPLAY_ON, power may be required from the gate driving circuit (130 in FIG. 1) for scanning a pixel P, from the data processing circuit (140 in FIG. 1) for generating image data, from the data driving circuit (120 in FIG. 120) for supplying a data voltage corresponding to the image data, and from a touch sensing circuit (not shown) for sensing a touch. The power management integrated circuit (150 in FIG. 1) may supply power to such circuits.

On the contrary, in the display non-driving section DISPLAY_OFF, since there is no panel driving, power may be required only from the touch sensing circuit (not shown) for sensing a touch. The power management integrated circuit (150 in FIG. 1) may supply power only to the touch sensing circuit.

As described above, power supplied by the power management integrated circuit (150 in FIG. 1) in the display driving section DISPLAY_ON or in the display non-driving section DISPLAY_OFF may mean power consumed in the respective sections. Accordingly, although power PWR will be described below as power supplied by the power management integrated circuit (150 in FIG. 1), it is not limited to this and can be understood as power consumed in the display device.

The load LD on the power management integrated circuit may be different in the display driving section DISPLAY_ON and in the display non-driving section DISPLAY_OFF.

The load LD in the display driving section DISPLAY_ON may be greater than the load LD in the display non-driving section DISPLAY_OFF. Since various circuits operate for driving the panel in the display driving section DISPLAY_ON and the circuits are loads, the load may be greater as the number of circuits in operation increases. On the contrary, since relatively few circuits, which are loads, operate in the display non-driving section DISPLAY_OFF, the load may be lesser as the number of circuits in operation decreases. The load LD imposed on the power management integrated circuit (150 in FIG. 1) may be great in the display driving section DISPLAY_ON and less in the display non-driving section DISPLAY_OFF. In this figure, the load LD in the display driving section DISPLAY_ON is indicated by HEAVY and the load LD in the display non-driving section DISPLAY_OFF is indicated by LIGHT (sections in shade).

Depending on operations of the panel, power PWR supplied by the power management integrated circuit (150 in FIG. 1) and the load LD imposed on the power management integrated circuit (150 in FIG. 1) may vary. For example, as the display driving section DISPLAY_ON and the display non-driving section DISPLAY_OFF alternate, supplied power PWR may alternate between in a HIGH state and in a LOW state and the load LD may also alternate between in a HEAVY state and in a LIGHT state in conformity with the alternation of the supplied power PWR.

Figure 4:
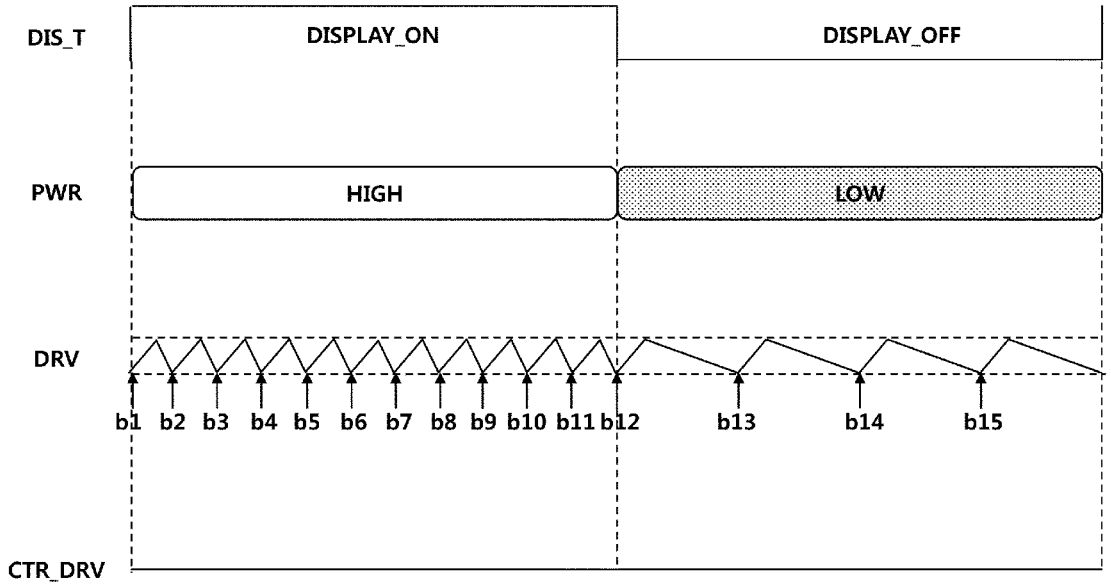
FIG. 4 (Related Art)
FIG. 4 is a diagram showing supplied power, a driving voltage, and a driving voltage control signal in a display driving section and in a display non-driving section according to a conventional art.

FIG. 4 is a diagram showing supplied power, a driving voltage, and a driving voltage control signal in a display driving section and in a display non-driving section according to a conventional art.

A conventional power management integrated circuit may output driving voltages to have a uniform amplitude of ripples regardless of in the display driving section DISPLAY_ON or in the display non-driving section DISPLAY_OFF. However, the period of a ripple may be longer in the display non-driving section DISPLAY_OFF than in the display driving section DISPLAY_ON.

Power PWR to be supplied may be transferred from the power management integrated circuit to external circuits in a form of a driving voltage DRV. The power management integrated circuit may output some driving voltages as soon as it generates them. The power management integrated circuit may also store some other voltages, generated during a predetermined period of time, in a capacitor and output them from the capacitor. For example, generated voltages may be outputted in a first term and stored voltages may be outputted in a second term.

When the stored voltages are outputted so that the capacitor is discharged, the level of a driving voltage DRV may be lowered. Since, when the level of a driving voltage is too low, operations of external circuits are unstable, the power management integrated circuit may again generate voltages when the level of the driving voltage DRV is lowered to a threshold value. The generated voltages may be stored in the capacitor. The level of the driving voltage DRV may increase again to the peak value. The power management integrated circuit (150 in FIG. 1) may stably supply power to the external circuits by increasing the level of the driving voltage DRV. When the level of the driving voltage increases to the peak value, the power management integrated circuit (105 in FIG. 1) may stop generating voltages. At this moment, the stored voltages may get out of the capacitor and be outputted as driving voltages DRV.

As described above, driving voltages may be generated during predetermined periods of time at regular intervals and may not be generated during the aforementioned intervals. However, regardless of being generated or not, driving voltages are continuously outputted.

A peak value and a threshold value may define a fluctuation range of the level of the driving voltage DRV to be outputted. A peak value and a threshold value may be an upper limit and a lower limit of the level of a driving voltage. A peak value and a threshold value may be a maximum level and a minimum level of a driving voltage.

When generated voltages and stored voltages are alternately outputted, the driving voltage DRV may have ripples. Because of a charging time delay during which the capacitor is charged by generated voltages, the level of the driving voltage DRV may not immediately come up to a desired value, but may slowly increase to the value. In addition, because of a discharging time delay during which the capacitor is discharged, the level of the driving voltage may not immediately come down to a desired value as soon as they are outputted, but may slowly decrease to the value. The repetition of such increases and decreases of the level of the driving voltage may form ripples.

In a case when power PWR supplied by the power management integrated circuit (150 in FIG. 1) is small, the discharging time delay may be longer than that in a case when supplied power PWR is large. In addition, in a case when a load LOAD requiring supplied power PWR is light, the discharging time delay may be longer than that in a case when the load LOAD is heavy.

Whenever the level of the driving voltage decreases to a threshold value, driving voltages DRV are generated. Here, since the generation of driving voltages lifts the level of the driving voltage DRV up, it may be referred to as a 'boost of driving voltages'.

The generation (boost) of driving voltages may cause power consumption in the power management integrated circuit (150 in FIG. 1). Here, consumed power and supplied power PWR in the power management integrated circuit (150 in FIG. 1) may have different meanings. The supplied power PWR may mean power supplied to external circuits by the power management integrated circuit (150 in FIG. 1) or consumed by the external circuits, whereas consumed power may mean power additionally consumed inside the power management integrated circuit (150 in FIG. 1) in order to supply power PWR to the external circuits.

Here, the frequent generations (boosts) of driving voltages DRV may increase power consumption of the power management integrated circuit (150 in FIG. 1).

Referring to FIG. 4, supplied (or consumed) power PWR may be high in the display driving section DISPLAY_ON and relatively low in the display non-driving section DISPLAY_OFF depending the operations of the panel indicated by a timing control signal DIS_T.

However, the fluctuation ranges of the driving voltage DRV may be the same in the display driving section DISPLAY_ON and in the display non-driving section DISPLY_OFF. That is, the driving voltage DRV may fluctuate between the same peak value and the same threshold value in both sections while they are outputted.

Driving voltages DRV may be intermittently generated in the display non-driving section DISPLAY_OFF and frequently generated in the display driving section DISPLAY_ON. In other words, the number of generations in the display non-driving section DISPLAY_OFF may be lesser than that in the display driving section DISPLAY_ON.

For example, in a case when the display driving section DISPLAY_ON and the display non-driving section DISPLAY_OFF have the same duration, driving voltages DRV may be generated eleven times b1 to b11 in the display driving section DISPLAY_ON and four times b12 to b15 in the display non-driving section DISPLAY_OFF.

Since the load is heavy and the power PWR consumed due to the load is high in the display driving section DISPLAY_ON, a period of time, during which the level of the driving voltage drops from the peak value to the threshold value, may be short. On the contrary, since the load is light and the power PWR consumed due to the load is low in the display non-driving section DISPLAY_OFF, a period of time, during which the level of the driving voltage drops from the peak value to the threshold value, may be long. Since the level of the driving voltage decreases more slowly in the display non-driving section DISPLAY_OFF than in the display driving section DISPLAY_ON, driving voltages DRV may be generated lesser frequently in the display non-driving section DISPLAY_OFF than in the display driving section DISPLAY_ON. Accordingly, a period of a ripple may be longer in the display non-driving section DISPLAY_OFF than in the display driving section DISPLAY_ON.

A driving voltage control signal CTR_DRV may comprise information for adjusting the fluctuation range of the driving voltage DRV. A driving voltage control signal CTR_DRV may determine the fluctuation ranges in the display driving section DISPLAY_ON and in the display non-driving section DISPLAY_OFF by changing its level.

According to a conventional art, the fluctuation ranges may be identical in both the display driving section DISPLAY_ON and the display non-driving section DISPLAY_OFF. This means that the driving voltage control signal CTR_DRV may have the same level for the display driving section DISPLAY_ON and for the display non-driving section DISPLAY_OFF.

Figure 5:
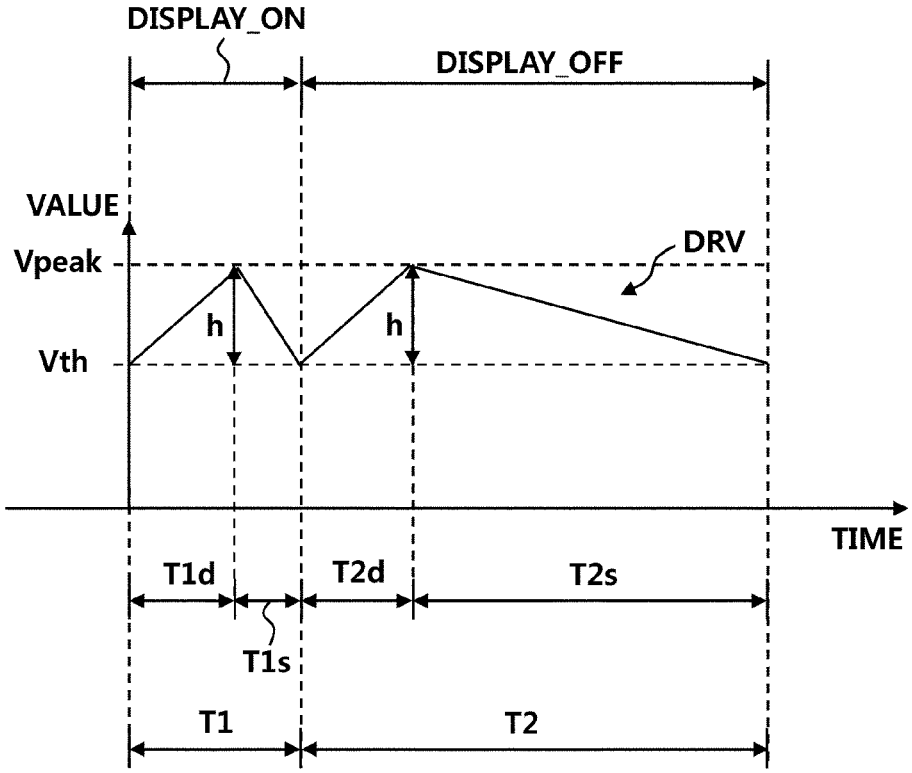
FIG. 5 (Related Art)
FIG. 5 is a diagram showing the comparison of supplied power, a driving voltage, and a driving voltage control signal in a display driving section and in a display non-driving section according to a conventional art.

FIG. 5 is a diagram showing the comparison of supplied power, a driving voltage, and a driving voltage control signal between in a display driving section and in a display non-driving section according to a conventional art.

Referring to FIG. 5, according to a conventional art, the driving voltage may have the same fluctuation range in both the display driving section DISPLAY_ON and the display non-driving section DISPLAY_OFF. A fluctuation range may affect a period and an amplitude of a ripple.

The driving voltage may have a ripple amplitude of h in the display driving voltage DISPLAY_ON and the display non-driving voltage DISPLAY_OFF. While driving voltages are generated, the level of the driving voltage may increase from a first threshold value Vth to a peak value Vpeak and while the generation is stopped, the level of the driving voltage may decrease from the peak value Vpeak to the first threshold value Vth. The ripple amplitude of h may correspond to a difference between the first threshold value Vth and the peak value Vpeak. The level of the driving voltage may maintain the ripple amplitude of h in both the display driving section DISPLAY_ON and the display non-driving section DISPLAY_OFF while alternately ascending and descending.

However, the level of the driving voltage DRV may have different ripple periods in the display driving section DISPLAY_ON and in the display non-driving section DISPLAY_OFF. A ripple period in the display non-driving section DISPLAY_OFF may be longer than that in the display driving section DISPLAY_ON.

A ripple period of the level of the driving voltage may comprise a driving period and a skip period. A driving period is a period where driving voltages DRV are generated and a skip period is a period where driving voltages are stopped being generated. A skip period in the display non-driving section DISPLAY_OFF is much longer than that in the display driving section DISPLAY_ON. Therefore, a ripple period in the display non-driving section DISPLAY_OFF may be longer than that in the display driving section DISPLAY_ON.

For example, a ripple period T1 in the display driving section DISPLAY_ON may comprise a driving period T1*d* and a skip period T1*s*. A ripple period T2 in the display non-driving section DISPLAY_OFF may also comprise a driving period T2*d* and a skip period T2*s*. Since the load is light and the power consumption is low in the display non-driving section DISPLAY_OFF, the level of the driving voltage may descend more slowly compared with in the display driving section DISPLAY_ON. Accordingly, a skip period T2*s* in the display non-driving section DISPLAY_OFF may be longer than a skip period T1*s* in the display driving section DISPLAY_ON.

When the ripple periods are different in the display driving section DISPLAY_ON and in the display non-driving section DISPLAY_OFF, ripple frequencies of the level of driving voltages may be different in the display driving section DISPLAY_ON and in the display non-driving section DISPLAY_OFF. The ripple frequency in the display non-driving section DISPLAY_OFF may be fewer than that in the display driving section DISPLAY_ON.

Figure 6:
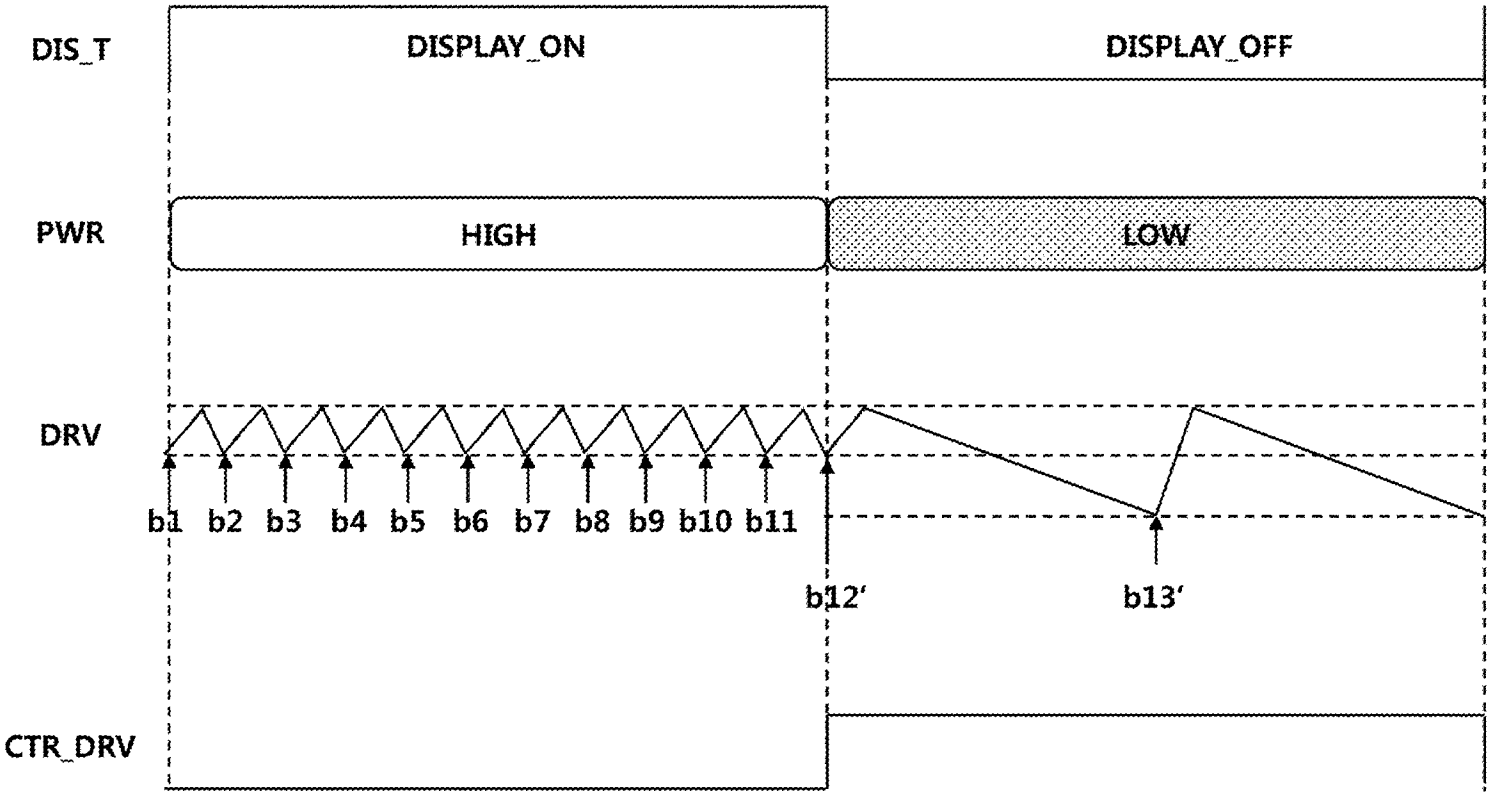
FIG. 6 is a diagram showing supplied power, a driving voltage, and a driving voltage control signal in a display driving section and in a display non-driving section according to an embodiment.

FIG. 6 is a diagram showing supplied power, a driving voltage, and a driving voltage control signal in a display driving section and in a display non-driving section according to an embodiment.

The power management integrated circuit (150 in FIG. 1) according to an embodiment may control the fluctuation range of the driving voltage DRV in the display non-driving section DISPLAY_OFF to be wider than the fluctuation range of the driving voltage according to a conventional art. In one embodiment, the fluctuation range in the display non-driving section DISPLAY_OFF may be set to be wider than the fluctuation range in the display driving section DISPLAY_ON.

When the fluctuation range in the display non-driving section DISPLAY_OFF is wider than the fluctuation range in the display driving section DISPLAY_ON, a ripple period in the display non-driving section DISPLAY_OFF may be longer than the ripple period according to a conventional art in which the fluctuation ranges are the same in the display driving section and in the display non-driving section.

In addition, a ripple amplitude in the display non-driving section DISPLAY_OFF may be greater than the ripple amplitude according to a conventional art and it may preferably be greater than a ripple amplitude in the display driving section DISPLAY_ON.

As the fluctuation range in the display non-driving section DISPLAY_OFF is wider, the number of times driving voltages DRV are generated may decrease and as the number of times of that the generation of the driving voltages DRV decreases, power consumption in the power management integrated circuit (150 in FIG. 1) may be reduced. That is, when the number of times that the driving voltages DRV are generated decreases, power consumption due to the generation of the driving voltages DRV may be reduced. Additionally, the ripples of the driving voltage DRV may flexibly be managed.

Referring to FIG. 6, the level of the driving voltage DRV in the display non-driving section DISPLAY_OFF may ascend or descend between a peak value and a threshold value lower than the threshold value according to a conventional art. When a reference value indicating the start of generating driving voltages DRV, that is, a threshold value becomes low, a range between a peak value and a threshold value may be wider than the range therebetween according to a conventional art.

A ripple period in the display non-driving section DISPLAY_OFF may be longer as the fluctuation range of a ripple is wider. Preferably, a ripple period may be longer as a threshold value is lower. The reason is that it takes more time for the level of the driving voltage to descend to the threshold value.

The number of times of generating (boosting) driving voltages in the display non-driving section DISPLAY_OFF may be reduced as the fluctuation range is wider. For example, driving voltages DRV are generated 4 times (b12 to b15 in FIG. 4) according to a conventional art, whereas driving voltages DRV are generated only twice (b12' and b13') according to an embodiment of the present disclosure.

Meanwhile, a driving voltage control signal CTR_DRV may comprise information to widen the fluctuation range of a driving voltage in the display non-driving section DISPLAY_OFF.

For example, in order to comprise information to adjust the fluctuation range in the display non-driving section DISPLAY_OFF to be wider than that in the display driving section DISPLAY_ON, a driving voltage control signal CTR_DRV may have a different level in the display non-driving section DISPLAY_OFF. The power stage of the power management integrated circuit (150 in FIG. 1) may lower a threshold value determining the fluctuation range in the display non-driving section DISPLAY_OFF according to the level of a driving voltage control signal CTR_DRV.

Figure 7:
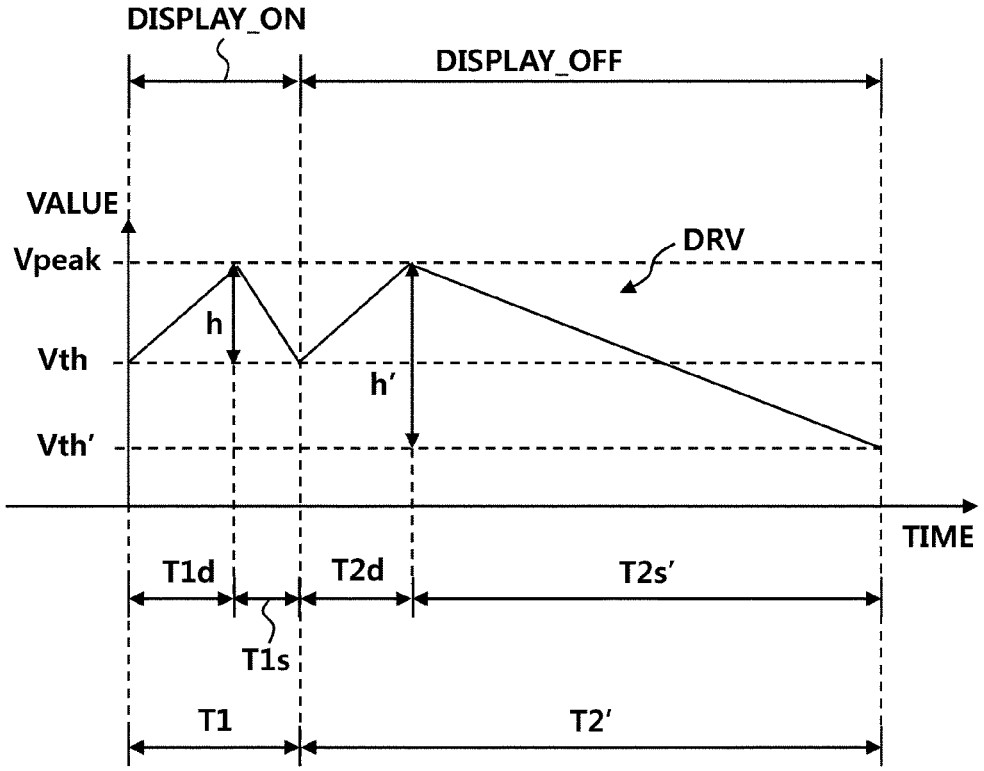
FIG. 7 is a diagram showing the comparison of supplied power, a driving voltage, and a driving voltage control signal in a display driving section and in a display non-driving section according to an embodiment.

FIG. 7 is a diagram showing the comparison of supplied power, a driving voltage, and a driving voltage control signal between in a display driving section and in a display non-driving section according to an embodiment.

Referring to FIG. 7, the power management integrated circuit (150 in FIG. 1) may control the driving voltage DRV such that its fluctuation range in the display non-driving section DISPLAY_OFF is wider than that in the display driving section DISPLAY_ON. In one embodiment, the power management integrated circuit (150 in FIG. 1) may control the lower limit of the fluctuation range in the display non-driving section DISPLAY_OFF to be lower than that in the display driving section DISPLAY_ON. The power management integrated circuit (150 in FIG. 1) may set a second threshold value Vth', indicating the start of generation of driving voltages, to be lower than the first threshold value Vth.

When the lower limit of the fluctuation range of the driving voltage DRV decreases to the second threshold value Vth' in the display non-driving section DISPLAY_OFF, the ripple amplitude of the driving voltage may be wider. The ripple amplitude h' in the display non-driving section DISPLAY_OFF may be wider than the ripple amplitude h in the display driving section DISPLAY_ON.

Additionally, the ripple period T2' in the display non-driving section DISPLAY_OFF according to the present disclosure may be longer than the ripple period (T2 in FIG. 5) in the display non-driving section according to a conventional art. When the level of the driving voltage DRV decreases to the second threshold value Vth', which is lower than the first threshold value Vth, the skip period T2*s*' in the display non-driving section DISPLAY_OFF according to the present disclosure may be longer than the skip period (T2*s* in FIG. 5) in the display non-driving section according to a conventional art.

On the contrary, the ripple frequency in the display non-driving section DISPLAY_OFF according to the present disclosure may be lower than the ripple frequency in the display non-driving section according to a conventional art. Since the ripple period T2' in the display non-driving section DISPLAY_OFF is longer than the ripple period in a case when the fluctuation range is not wide, the ripple frequency may be lower because the period is in inverse proportion to the frequency.

Figure 8:
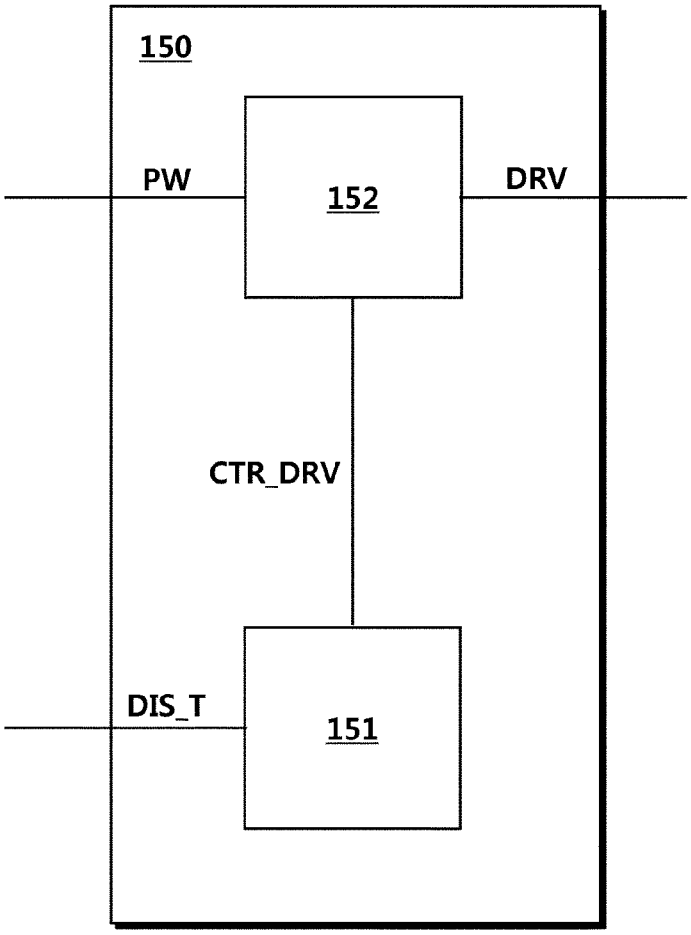
FIG. 8 is a configuration diagram of a power management integrated circuit according to an embodiment.

FIG. 8 is a configuration diagram of a power management integrated circuit according to an embodiment.

Referring to FIG. 8, the power management integrated circuit 150 may comprise a power control circuit 151 and a power stage 152.

The power control circuit 151 may receive a control signal comprising a timing control signal DIS_T. A control signal may be generated in the data driving circuit (120 in FIG. 1) or in the data processing circuit (140 in FIG. 1) and transmitted to the power control circuit 151. A timing control signal DIS_T may indicate whether the panel operates in a first time section where a data voltage for image data is applied or in a second time section where a data voltage is not applied. Here, the first time section may be referred to as a display driving section and the second time section may be referred to as a display non-driving section (a blank section). The power control circuit 151 may generate driving voltage control signals CTR_DRV to determine the fluctuation range of a driving voltage in each section according to timings indicated by a timing control signal DIS_T.

The power stage 152 may receive a power signal PW and convert it into a driving voltage DRV suitable for driving a circuit. For example, for the data driving circuit (120 in FIG. 1), the gate driving circuit (130 in FIG. 1), and the data processing circuit (140 in FIG. 1), different driving voltages may be generated. That is, driving voltages respectively have different voltage values or different voltage ranges depending on the circuits.

The power stage 152 may output driving voltages DRV. The power stage 152 may convert a power signal PW into a driving voltage DRV. In other words, the power stage 152 may generate driving voltages. Since driving voltages are generated while they are continuously supplied to external circuits, their level may increase from the low to the high.

The power stage 152 may not convert a power signal PW into a driving voltage. In other words, the power stage 152 may not generate driving voltages. Since driving voltages are not generated while they are continuously supplied to external circuits, their level may decrease from the high to the low.

The level of a driving voltage may ascend or descend between the low and the high. Such ascending and descending of the level of a driving voltage may form ripples.

The power control circuit 151 may generate a driving voltage control signal CTR_DRV to control the power stage 152 and transmit it to the power stage 152. A driving voltage control signal CTR_DRV may include information to determine the fluctuation range of the driving voltage DRV. The power control circuit 151 may adjust the peak value, which is a upper limit of the fluctuation range, and the threshold value, which is the lower limit of the fluctuation range, using a driving voltage control signal CTR_DRV.

For example, the power control circuit 151 may transmit a driving voltage control signal CTR_DRV to the power stage 152 to lower the threshold value of the fluctuation range. The power stage 152 may output driving voltages DRV on the basis of a lowered threshold value, instead of the original threshold value. When the display non-driving section starts, the power stage 152 may convert the power and the level of a driving voltage DRV may increase to the peak value. When the level of the driving voltage reaches the peak value, the power stage 152 may stop converting the power and the level of the driving voltage DRV may decrease to the lowered threshold value, which is lower than the original threshold value.

The aforementioned timing control signal may be a synchronization signal or a signal induced by a synchronization signal. For example, a timing control signal may be a horizontal synchronization signal HSYNC, a vertical synchronization signal VSYNC, or a signal induced by a horizontal synchronization signal HSYNC or a vertical synchronization signal VSYNC. The power management integrated circuit may receive a horizontal synchronization signal and generate a timing control signal using an internal clock signal. Or, the power management integrated circuit may receive a vertical synchronization signal VSYNC and generate a timing control signal using an internal clock signal.

What is claimed is:

1. A display device comprising:

a panel comprising pixels to which image data is outputted;

a data driving circuit to apply a data voltage corresponding to the image data to a pixel from the pixels in a first time section, but does not apply the data voltage to the pixel in a second time section; and a power management integrated circuit to convert power supplied from outside to generate a driving voltage and to output the driving voltage to the data driving circuit, wherein the power management integrated circuit controls a fluctuation range of the driving voltage in the second time section to be wider than a fluctuation range of the driving voltage in the first time section, wherein the fluctuation range in at least one of the first time section or the second time section comprises a peak value which is a maximum level value of the driving voltage and a threshold value which is a minimum level value of the driving voltage, and a level of the driving voltage ascends or descends between the threshold value and the peak value while the driving voltage is being outputted, wherein the power management integrated circuit controls the threshold value in the second time section to be lower than the threshold value in the first time section.

2. The display device of claim 1, wherein the power management integrated circuit receives a timing control signal including timings for the first time section and the second time section and outputs the driving voltage in the first time section or in the second time section according to the timings.

3. The display device of claim 2, wherein the timing control signal is generated in the data driving circuit or a data processing circuit to control the data driving circuit and is transmitted to the power management integrated circuit.

4. The display device of claim 1, wherein the power management integrated circuit stops generating the driving voltage during a skip period where the level of the driving voltage descends from the peak value to the threshold value and generates the driving voltage during a driving period where the level of the driving voltage ascends from the threshold value to the peak value.

5. The display device of claim 4, wherein the power management integrated circuit starts converting the power when the level of the driving voltage reaches the threshold value.

6. The display device of claim 5, wherein the power management integrated circuit stops converting the power when the level of the driving voltage reaches the peak value.

7. The display device of claim 4, wherein the skip period is longer than the driving period.

8. The display device of claim 4, wherein the power management integrated circuit controls the skip period of the second time section to be longer as the threshold value of the second time section becomes lower.

9. The display device of claim 4, wherein the power management integrated circuit controls a number of alternations of the driving period and the skip period in the second time section to be less as the threshold value of the second time section becomes lower.

10. The display device of claim 1, wherein the driving voltage forms ripples by levels of the driving voltage ascending or descending between the threshold value and the peak value, a ripple has a ripple amplitude which is a distance between the threshold value and the peak value, and the ripple amplitude of the second time section is greater than the ripple amplitude of the first time section.

11. A power management integrated circuit comprising:

a power stage to convert power supplied from outside to generate a driving voltage and to output the driving voltage; and a power control circuit to receive a timing control signal including timings for a first time section where a data voltage corresponding to image data is applied to a pixel and for a second time section where the data voltage is not applied to the pixel, and to control the output of the driving voltage, wherein the power control circuit determines the first time section and the second time section according to the timings, and controls the driving voltage such that a fluctuation range of the driving voltage in the second time section to be greater than a fluctuation range of the driving voltage in the first time section, wherein the fluctuation range in at least one of the first time section or the second time section comprises a peak value which is a maximum level value of the driving voltage and a threshold value which is a minimum level value of the driving voltage, and the power control circuit controls the threshold value in the second time section to be lower than the threshold value in the first time section.

12. The power management integrated circuit of claim 11, wherein the power stage converts the power when a level of the driving voltage reaches the threshold value.

13. The power management integrated circuit of claim 11, wherein the power stage stops converting the power when a level of the driving voltage reaches the peak value.

* * * * *